US007954751B2

(12) United States Patent
Chen

(10) Patent No.: US 7,954,751 B2
(45) Date of Patent: Jun. 7, 2011

(54) ROLLER STRUCTURE FOR FABRIC WINDING MACHINE

(75) Inventor: Shih-Chi Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 57 days.

(21) Appl. No.: 12/496,127

(22) Filed: Jul. 1, 2009

(65) Prior Publication Data

US 2011/0000997 A1 Jan. 6, 2011

(51) Int. Cl.
*B65H 75/08* (2006.01)

(52) U.S. Cl. ..... 242/613.1; 242/613.2; 242/599

(58) Field of Classification Search ..... 242/599, 242/599.1, 613, 613.1–613.2, 607, 609, 599.3–599.4
See application file for complete search history.

(56) References Cited

U.S. PATENT DOCUMENTS

| | | | | |
|---|---|---|---|---|
| 1,098,479 | A * | 6/1914 | Clark | 242/609 |
| 1,927,197 | A * | 9/1933 | Alderfer | 242/610.1 |
| 2,916,226 | A * | 12/1959 | McGraw, Jr. | 242/610.4 |
| 4,148,441 | A * | 4/1979 | Cohen | 242/160.4 |

FOREIGN PATENT DOCUMENTS

| | | |
|---|---|---|
| CN | I248485 | 2/2006 |
| CN | M303921 | 1/2007 |
| CN | M307018 | 3/2007 |
| CN | I296293 | 5/2008 |
| CN | M348770 | 1/2009 |

* cited by examiner

*Primary Examiner* — Sang Kim
(74) *Attorney, Agent, or Firm* — Muncy, Geissler, Olds & Lowe, PLLC

(57) ABSTRACT

A roller mounted onto a fabric winding machine to roll up fabric aims to solve the shortcomings of the conventional rollers that tend to cause fabric skewing during fabric rolling and are difficult to remove due to a lengthy structure. The roller of the invention has an outer diameter gradually enlarged towards two ends, and includes a first half roller and a second half roller that have respectively a first positioning portion and a second positioning portion at one end corresponding and fastenable to each other. The greater diameters at two ends allow the fabric to be rolled up on the roller without skewing. The two pieces design of the roller makes each piece shorter and removing from a bundle of rolled up fabric easier. The roller thus formed can facilitate fabric rolling and removal thereof.

6 Claims, 7 Drawing Sheets

ROLLER STRUCTURE FOR FABRIC WINDING MACHINE

FIELD OF THE INVENTION

The present invention relates to a roller structure for a fabric winding machine and particularly to a roller structure of a fabric winding machine used on a circular knitting machine.

BACKGROUND OF THE INVENTION

A fabric winding machine is located below a circular knitting machine to drive a roller to roll up a fabric knitted by the circular knitting machine into a neat bundle. Reference of related techniques can be found in R.O.C. patent Nos. M348770, M307018 and M303921. They all disclose a roller in a cylindrical shape. In order to facilitate removal of the roller after fabric winding operation is finished, the outer diameter of the roller is gradually increased from one end towards the other end. To prevent insufficient friction between the surface of the roller and the fabric during fabric winding, the surface of the roller has to be formed in a non-smooth or anti-slipping fashion. Although the diameter of the cylindrical roller is gradually enlarged, the non-smooth or anti-slipping surface increases the friction between the roller and fabric, this makes removing of the roller difficult.

To remedy the aforesaid dilemma of easy fabric winding but difficult removing, improved techniques have been developed such as R.O.C. patent Nos. I296293 and I248485. Both provide a roller which also has the outer diameter gradually enlarged from one end towards the other end, but the outer surface of the roller is a polygon consisting of multiple planes rather than cylindrical. Such a structure has surface angles to increase friction during fabric winding without forming anti-slipping surfaces and the surfaces may also be smooth. The roller thus formed can facilitate fabric winding, and removing of the roller also is easier due to smaller friction.

While the polygonal roller can solve the problem of the cylindrical one, both of them still have drawbacks in practice, notably:

1. The roller is lengthy and results in a greater contact area between the roller and the fabric. Friction between them also is greater. Removing the roller is difficult and takes more time. The fabric in the middle of the bundle is easily drawn out during removing of the roller. Hence removing the roller is troublesome.

2. As the outer diameter of the roller gradually enlarges towards one end, when the fabric winding machine rotates to drive the roller to roll up the fabric, the fabric tends to skew due to rotation of the fabric winding machine. The entire bundle of the fabric could even be thrown out.

SUMMARY OF THE INVENTION

The primary object of the present invention is to solve the aforesaid problem to reduce the difficulty of removing the roller and make removing of the roller easier, and also prevent skewing of the fabric during rolling up operation to allow the fabric to be steadily rolled up on the roller.

To achieve the foregoing object, the present invention provides a roller used on a fabric winding machine to roll up fabric. The roller has outer diameters gradually enlarged towards two ends. It includes a first half roller and a second half roller. The first half roller and the second half roller have respectively a first positioning portion and a second positioning portion at one end corresponding and fastenable to each other to form the roller. The first half roller and the second half roller thus formed provides a smaller contact area with the fabric, hence the roller is easier to remove. Moreover, as the outer diameters of the roller are gradually enlarged towards the two ends, the fabric is confined to the center portion of the roller during fabric rolling operation without skewing. Hence the fabric can be steadily rolled up on the roller.

In an embodiment of the invention, the first and second half rollers are formed with polygonal outer walls consisting of multiple plane and smooth surfaces. The polygonal structure can increase friction between the roller and the fabric to facilitate fabric rolling. The smooth surfaces of the outer walls can reduce friction resistance to make removing of the roller easier.

In short, compared with the conventional techniques, the invention provides many benefits, such as:

1. Removing the roller is easier and takes less time, and operation efficiency increases.

2. Improving fabric rolling quality.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
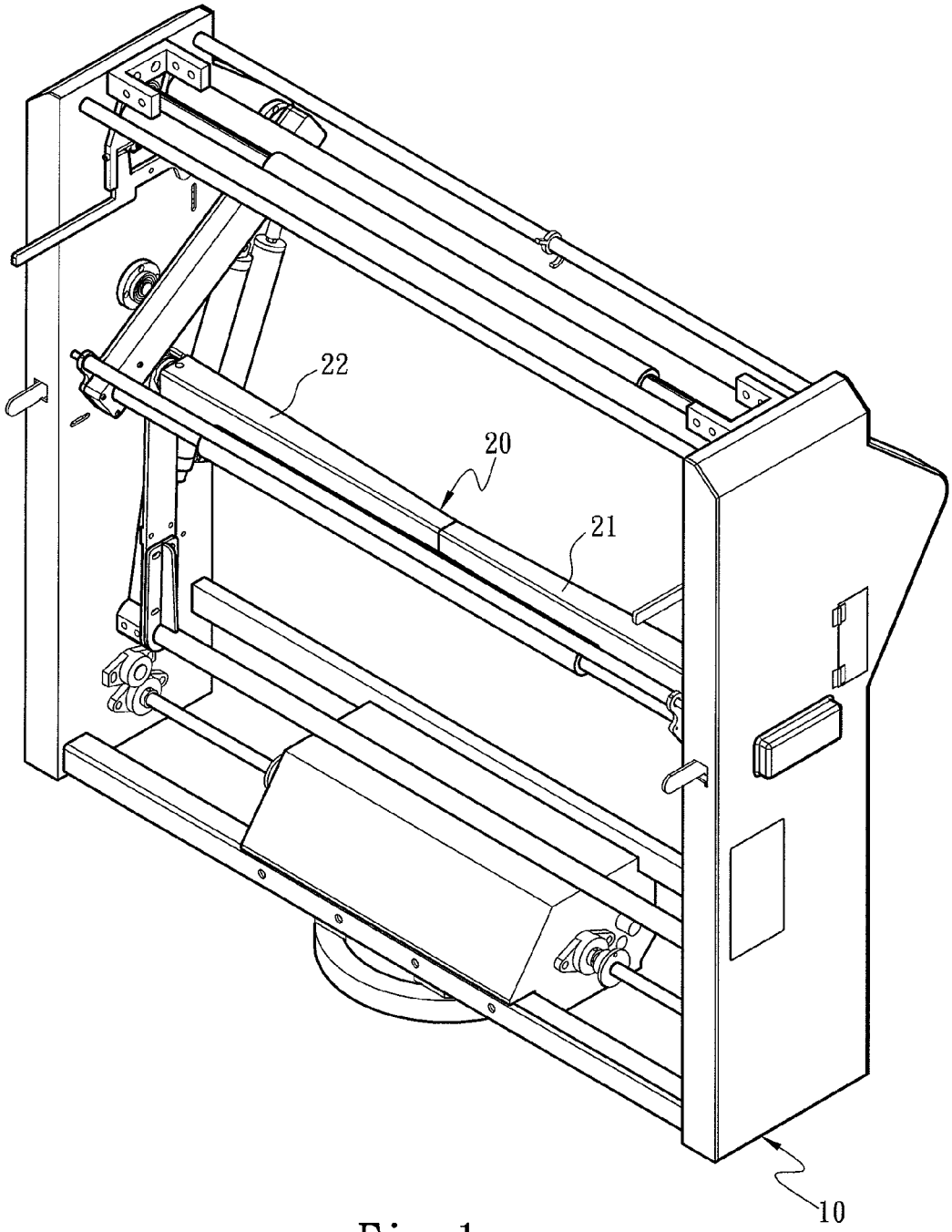
FIG. 1 is a schematic view of an embodiment of the invention.
Figure 2:
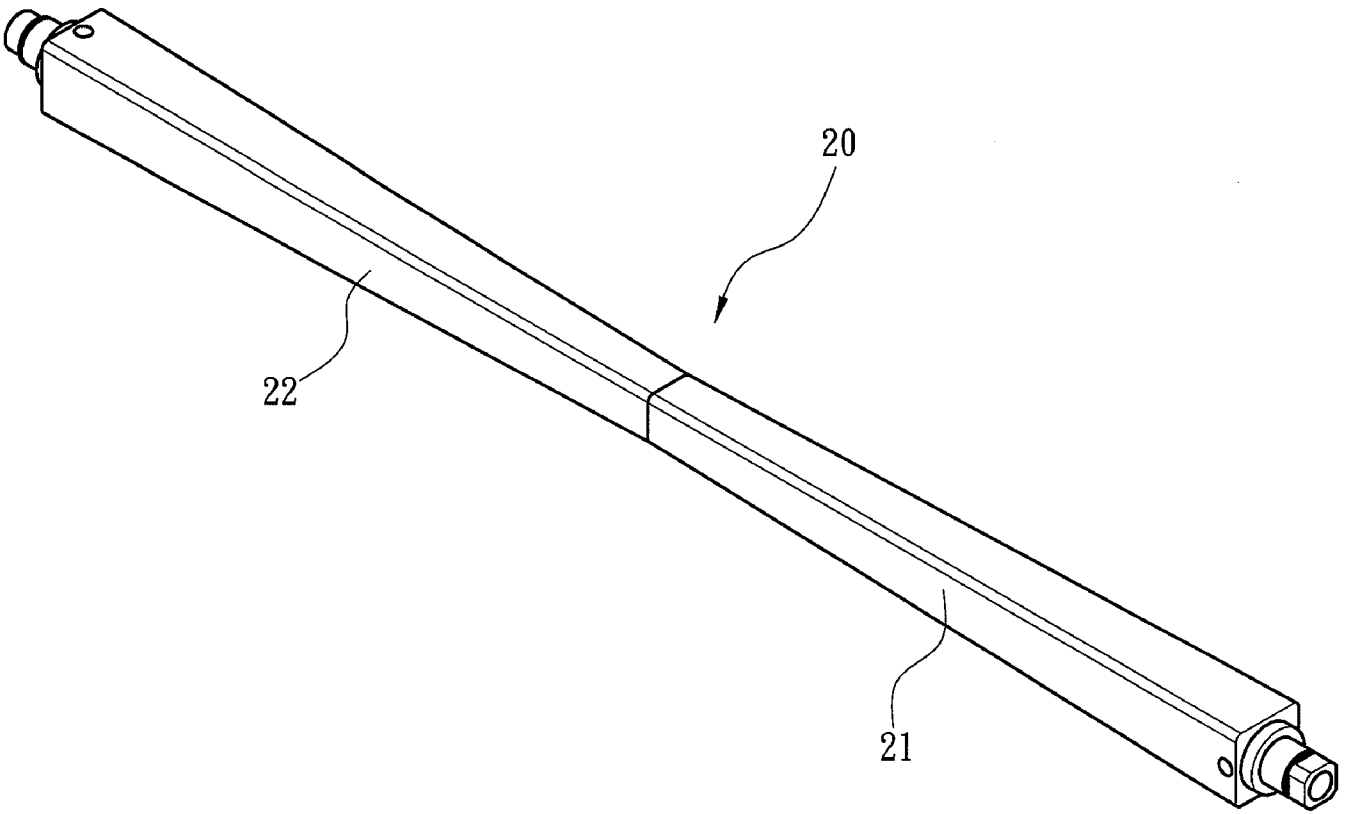
FIG. 2 is a perspective view of the invention.
Figure 3:
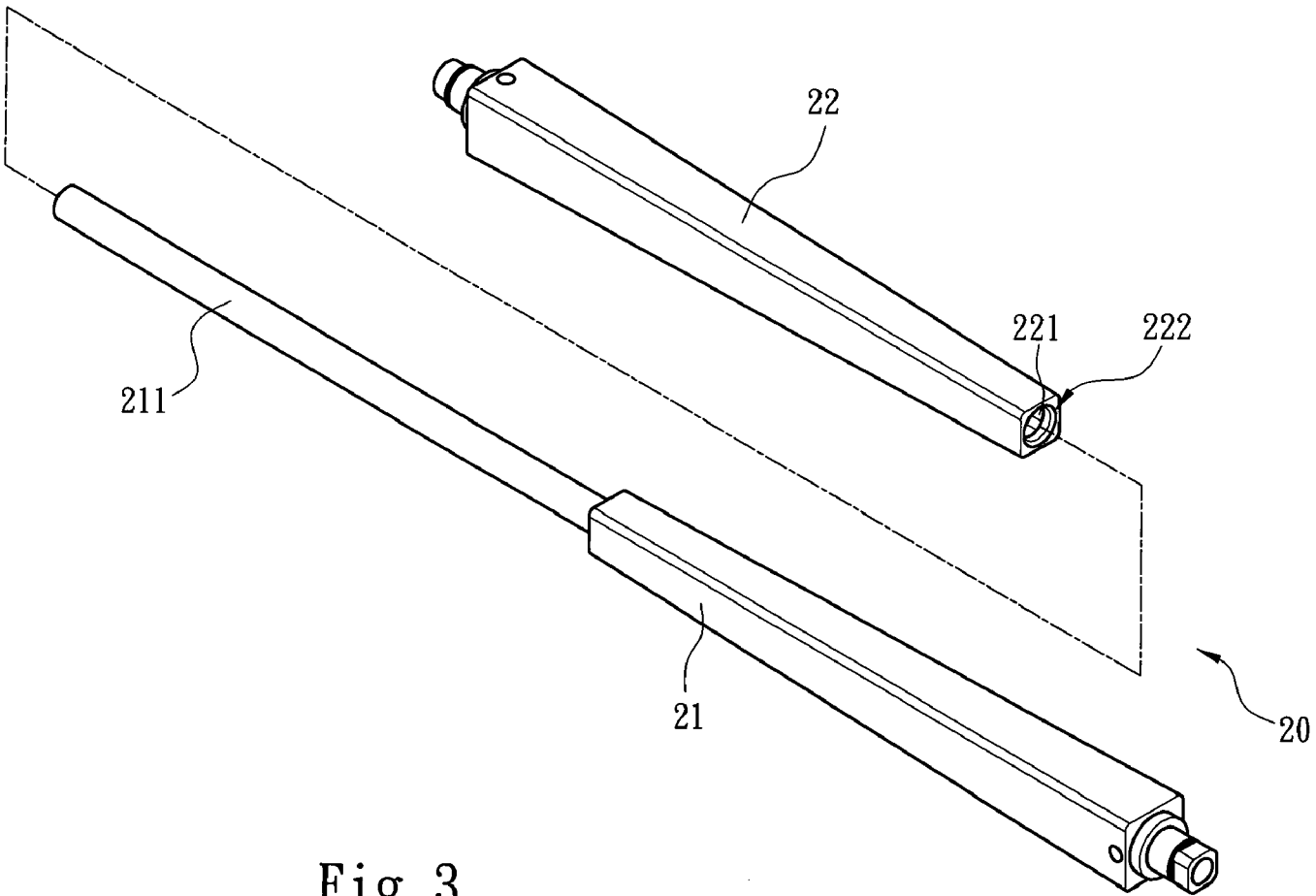
FIG. 3 is an exploded view of the invention.
Figure 4:
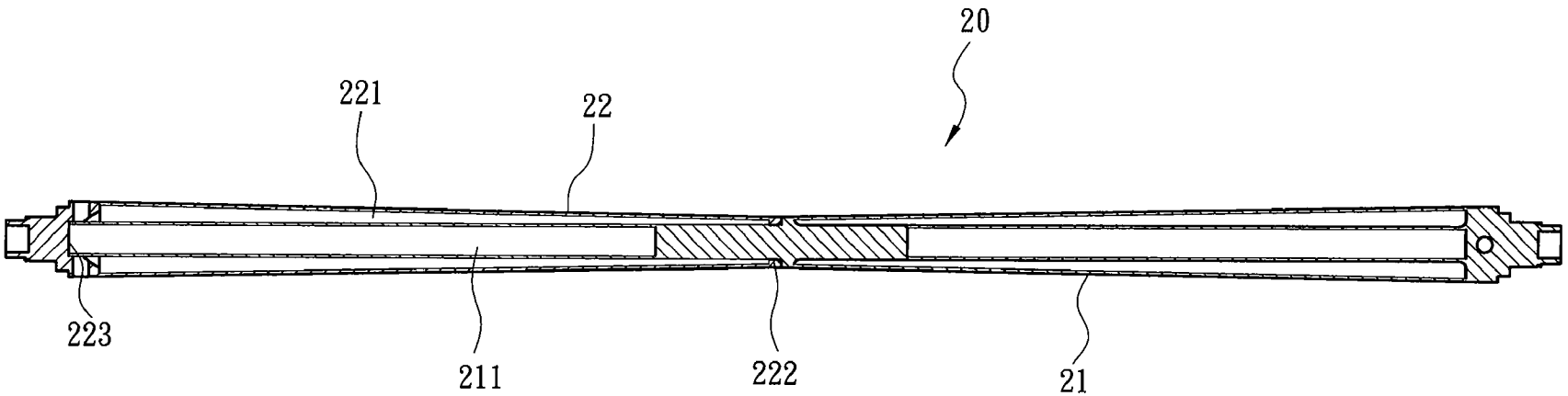
FIG. 4 is a sectional view of the invention.

Please refer to FIGS. 1 through 4, the present invention provides a roller 20 for a fabric winding machine. The roller 20 is mounted onto a fabric winding machine 10 to roll up fabric. The roller 20 includes a first half roller 21 and a second half roller 22 that have the same length, and have respectively a first positioning portion 211 and a second positioning portion 221 at one end corresponding to each other so that they can be fastened together form the whole set of the roller 20. The roller 20 is formed at an outer diameter gradually enlarged towards two ends, namely the diameter of the first half roller 21 increases gradually from the first positioning portion 211 towards one end where it is held on the fabric winding machine 10, and same is happened to the second half roller 22 with the diameter gradually increased from the second positioning portion 221 towards another end where it is also held on the fabric winding machine 10, thus forms the main structure of the invention. In an embodiment of the invention, the first and second positioning portions 211 and 221 are a strut and a trough mating and fastenable to each other. The second positioning portion 221 has an opening 222 at one end and a coupling portion 223 at a second end coupled with an end of the first positioning portion.

The first and second half rollers 21 and 22 have outer walls formed in a polygonal structure consisting of multiple planes to facilitate fabric rolling. Hence there is no need to form anti-slipping surfaces on the roller 20. The outer walls of the first and second half rollers 21 and 22 may be formed in smooth surfaces to reduce friction between the roller 20 and the contacted fabric. Such a structure also makes removing of the roller 20 easier. Because of the roller 20 is formed with greater diameters at the two ends, skewing of the fabric rolled up on the roller 20 is less likely to happen. Thus the fabric can be rolled up steadily on the roller 20.

Figure 5A:
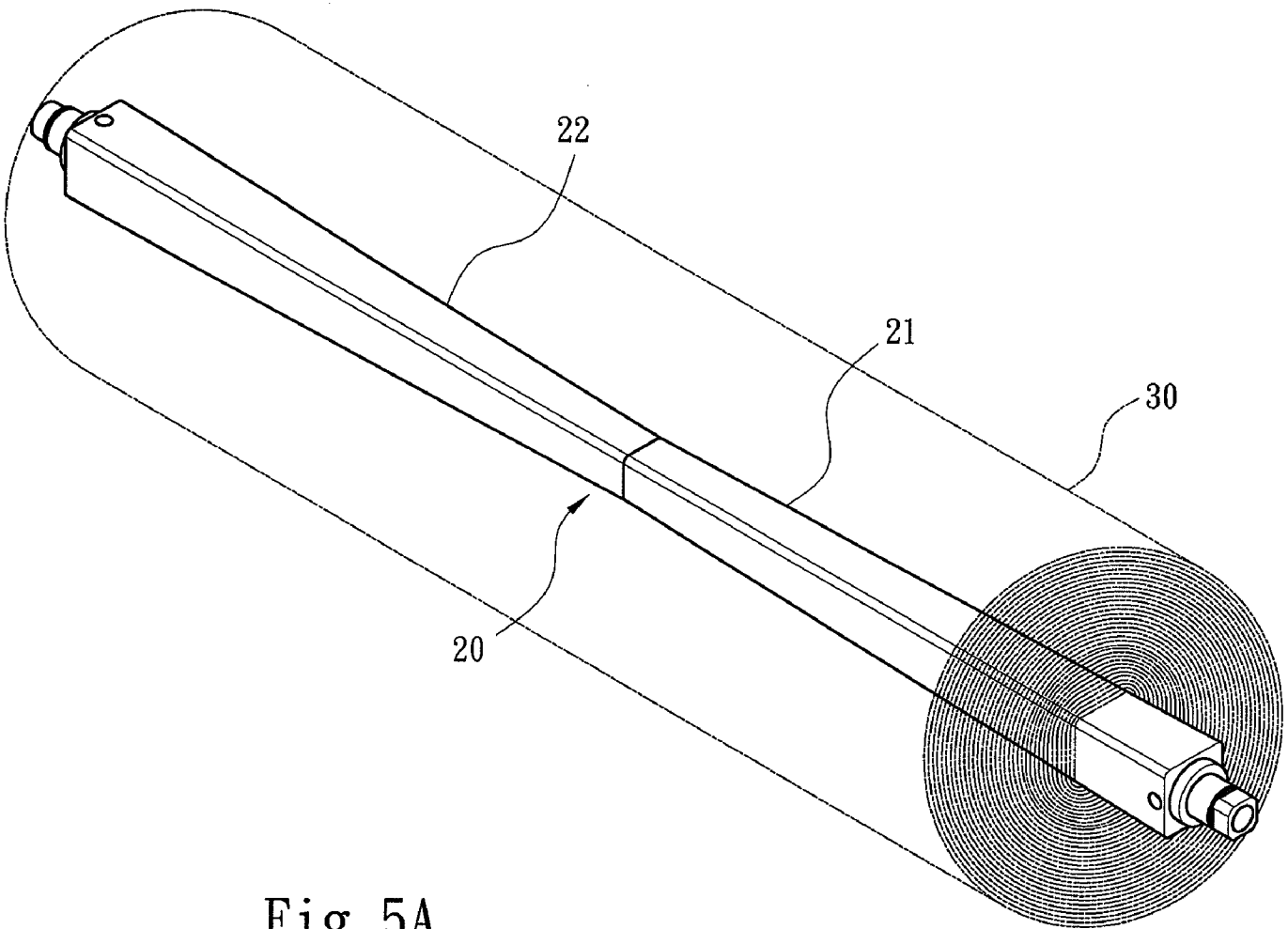
FIGS. 5A, 5B and 5C are schematic views of the invention in operating conditions.
Figure 5B:
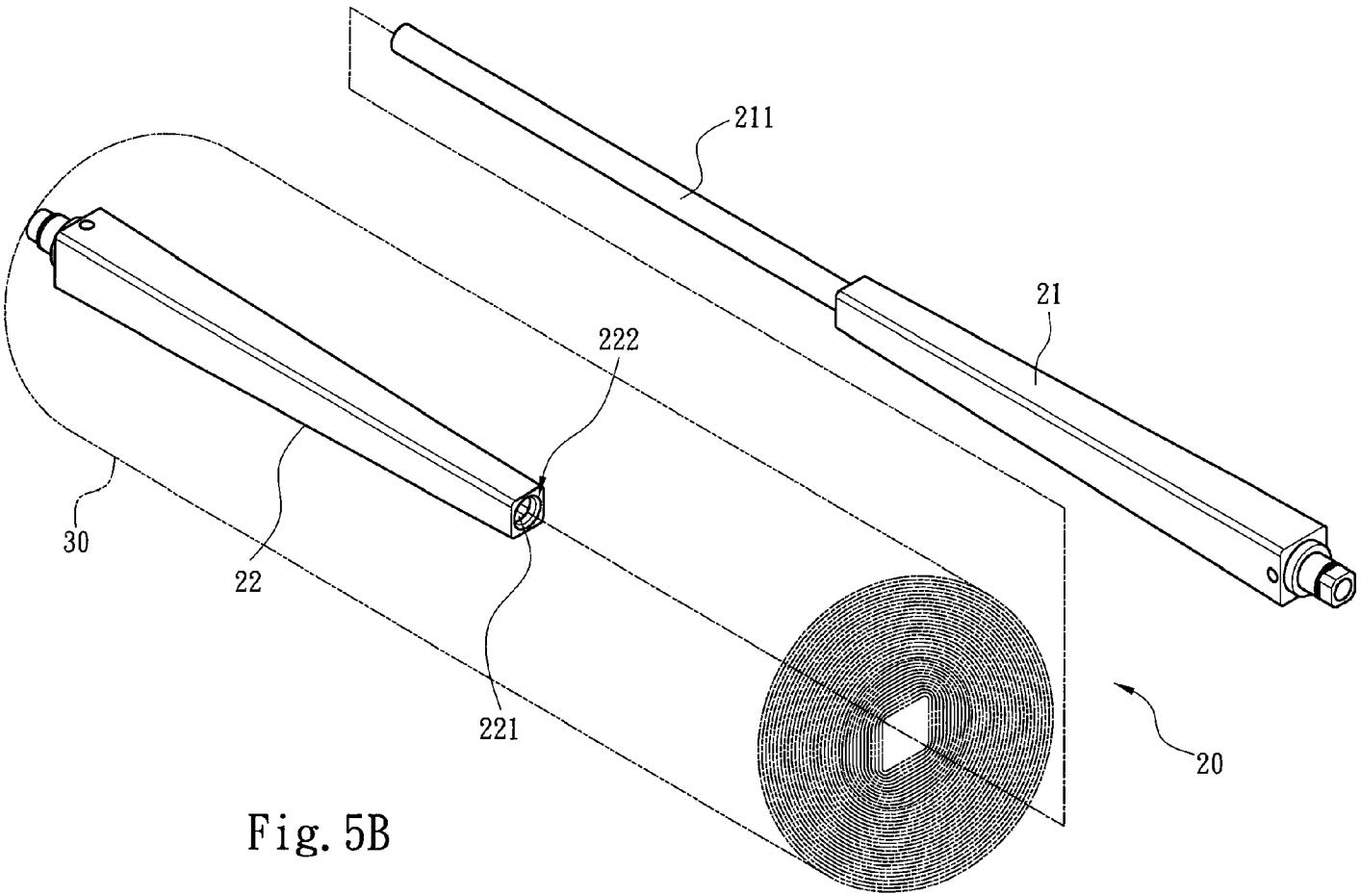
Figure 5C:
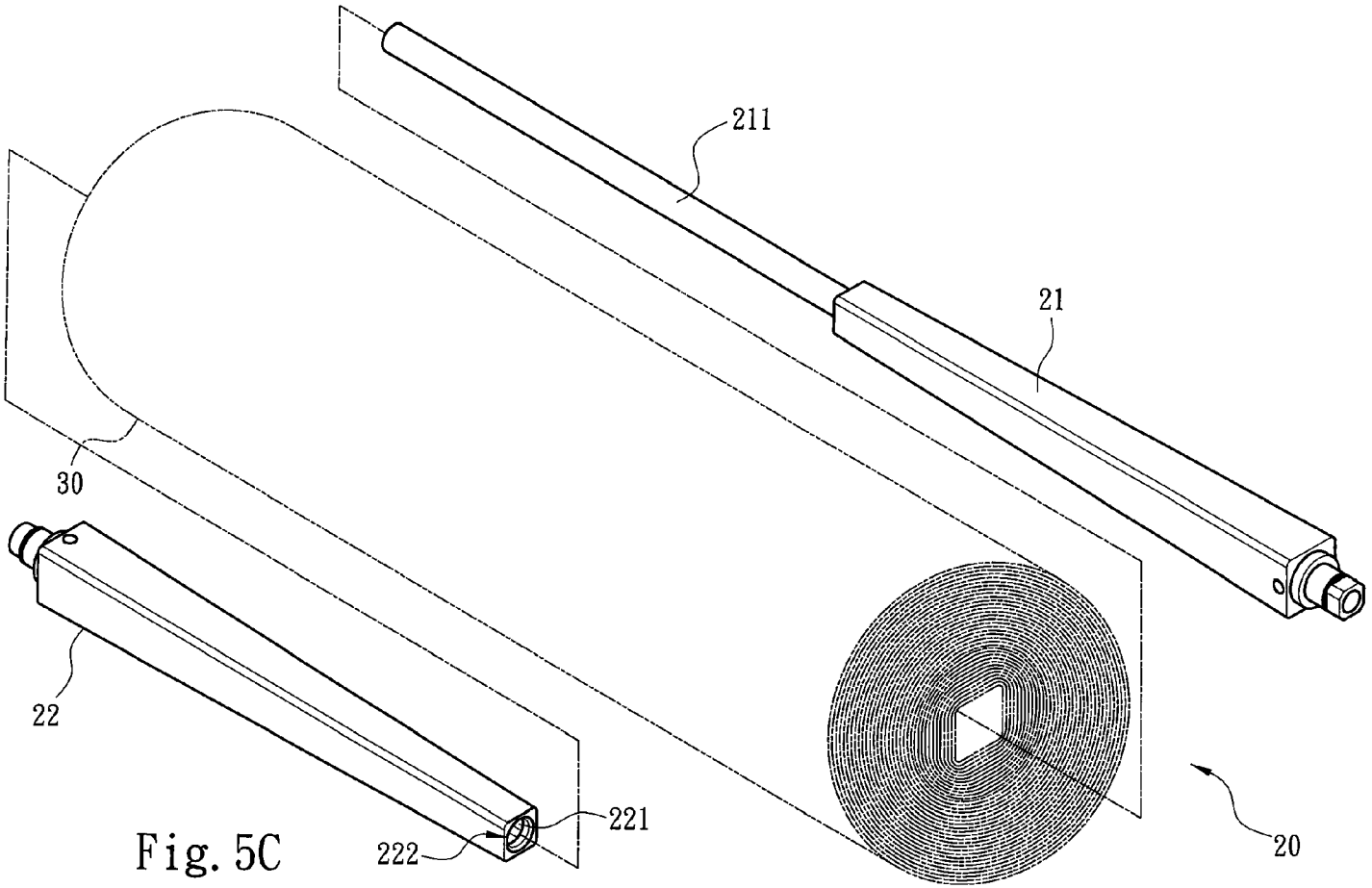

Referring to FIGS. 5A through 5C, when fabric rolling operation is finished and removing of the roller 20 is desired, first, remove the first half roller 21 by separating the strut of the first positioning portion 211 from the trough of the second positioning portion 221. As the strut is formed at a diameter smaller than the first half roller 21, during removal of the first half roller 21, a gap is formed between the strut and the fabric 30, hence contact between the two and friction resistance occurred also are smaller. Therefore, removing the first half roller 21 is easier. Afterwards, the second half roller 22 also can be removed to complete removing of the roller 20.

As a conclusion, the invention mainly divides the roller 20 into the first half roller 21 and the second half roller 22 that are fastenable to each other. As the first and second half rollers 21 and 22 are formed at one half of the length of the roller 20, and can be removed from two sides of the fabric 30, each forms a smaller contact area with the fabric 30 and the roller 20 can be removed easier. Moreover, the outer diameter of the roller 20 gradually enlarged towards two ends, during fabric rolling operation, the rolled up fabric 30 is confined in the center portion of the roller 20 without skewing so that the fabric 30 can be steadily rolled up on the roller 20.

In short, compared with the conventional techniques, the present invention provides many benefits, notably:

1. Removing of the roller 20 is easier and takes less time, hence improves operation efficiency.

2. Improving the quality of fabric rolling operation.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A roller structure for a fabric winding machine to be mounted onto the fabric winding machine to roll up a fabric, comprising:

a first half roller and a second half roller that have respectively a first positioning portion protruding therefrom and a second positioning portion formed inside, the second positioning portion including an opening receiving the first positioning portion at one end and a coupling portion connected with one end of the first positioning portion at another end, so that the first and second positioning portions are coupled to each other to form the whole set of the roller which has an outer diameter gradually enlarged towards two ends thereof.

2. The roller structure of claim 1, wherein the first half roller and the second half roller have outer walls formed in smooth surfaces.

3. The roller structure of claim 2, wherein the outer walls of the first half roller and the second half roller formed in a polygonal structure consisting of multiple planes.

4. The roller structure of claim 1, wherein the first half roller and the second half roller have outer walls formed in a polygonal structure consisting of multiple planes.

5. The roller structure of claim 1, wherein the first half roller and the second half roller are formed at a same length.

6. The roller structure of claim 1, wherein the first half roller is formed at an outer diameter enlarged gradually from one end where the first positioning portion is formed towards another end, and the second half roller is formed at another outer diameter enlarged gradually from one end where the second positioning portion is formed towards another end thereof.

* * * * *